US007118410B2

(12) United States Patent
Hatori

(10) Patent No.: US 7,118,410 B2
(45) Date of Patent: Oct. 10, 2006

(54) WIRING PROTECTOR

(75) Inventor: Shouji Hatori, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/979,215

(22) Filed: Nov. 3, 2004

(65) Prior Publication Data

US 2005/0106934 A1 May 19, 2005

(30) Foreign Application Priority Data

Nov. 14, 2003 (JP) ..... 2003-385867

(51) Int. Cl.
*H01R 13/72* (2006.01)

(52) U.S. Cl. ..... 439/501; 439/719

(58) Field of Classification Search ..... 439/501, 439/719, 624

See application file for complete search history.

(56) References Cited

U.S. PATENT DOCUMENTS 6,076,315 A 6/2000 Kondo ..... 52/220.1

6,217,375 B1 * 4/2001 Nagai et al. ..... 439/501

FOREIGN PATENT DOCUMENTS

JP 9-117032 5/1997

OTHER PUBLICATIONS

English language Abstract of JP9-117032.

* cited by examiner

*Primary Examiner*—Javaid H. Nasri
(74) *Attorney, Agent, or Firm*—Greenblum & Bernstein, P.L.C.

(57) ABSTRACT

A wiring protector that controls the direction of exiting branch wires, secures a tube over the branch wires, and adjusts the length of the branch wires. Wire protector, which includes main body and a passageway formed therein through which trunk wires pass, is placed over a wire harness and attached to a vehicle body. Exit ports for branch wires are formed within the main body, and disk-shaped guide members or a clamp are attached to the internal region of the main body to control the exit direction of the branch wires and to determine the length of the branch wires.

8 Claims, 8 Drawing Sheets

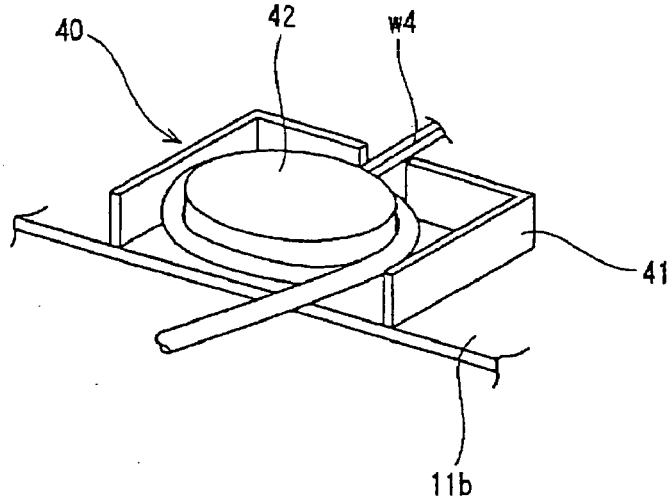
FIGURE 7A
FIGURE 7B
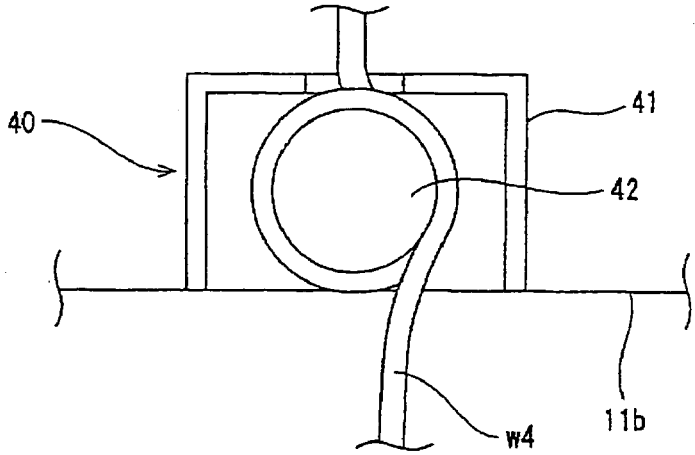
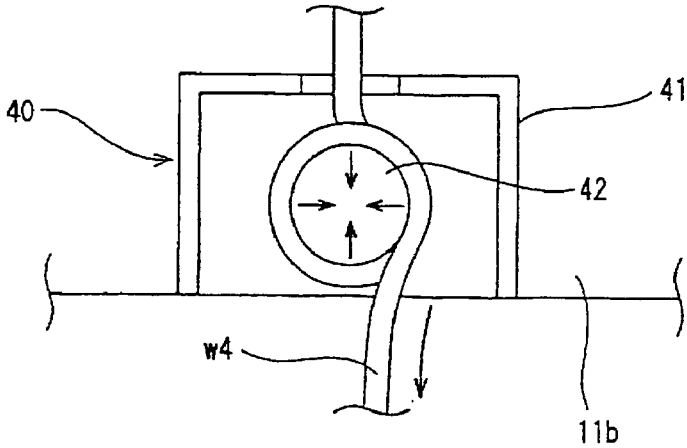
FIGURE 7C

WIRING PROTECTOR

BACKGROUND OF THE INVENTION

1. Field of the Invention

The present invention relates to a wiring protector, and more particularly to a wiring protector positioned over branch joints of a wiring harness that may be attached to a vehicle. The wiring protector establishes the direction that branch wires extend from the wiring harness, secures tubes attached to the branch wires, and adjusts the length of the branch wires.

2. Description of Background Information

As shown in FIG. 8 and described by Japanese Kokai (Laid Open) Patent H9-117032, protector 1 is an example of a prior art wiring protector that fits over the branching wire locations of a wire harness attached to an automobile. Protector 1 is a one-piece structure that includes open-ended main body 2 which is placed around trunk wires w1 of wire harness WH at the location where branch wires separate therefrom, and lid 3 that exposes or covers the upper portion of main body 2 by pivoting on flexible hinge portion 4. Cutout portion 2*b* is formed in sidewall 2*a* on main body 2 to allow the passage of branch wires w2 therethrough.

The design of the prior art protector does not regulate the extending direction of branch wires w2 because branch wires 2*w* are merely pulled through cutout portion 2*b* in main body 2. Also, because a protective tube is placed over the exposed portion of branch wires w2 exiting protector 1, tape must be wrapped around the tube to prevent it from becoming displaced in the axial direction along branch wires w2. Moreover, connector 5 is attached to the end of branch wires w2 to connect the branch wires to a terminal device (not shown in the drawing). Branch wires w2 can become slack in the region external to protector 1 after connector 5 is attached to the terminal device, and the slack portion may interfere with other components. This slackness can also result in the branch wires generating noise induced by vehicle vibration.

SUMMARY OF THE INVENTION

Taking the above-noted shortcomings into consideration, the wiring protector of the present invention is constructed at least to control the direction from which branch wires exit the wiring protector, to securely fix the tubes covering the branch wires, and to adjust the length of the branch wires.

In order to resolve the shortcomings in the prior art, the wiring protector of the present invention controls the length and direction of branch wires extending from the trunk wires of a wiring harness attached to a vehicle through the following structure. A passageway is provided in a main body for the passage of the trunk wires, branch wire exit ports are formed within and aligned along the front wall of the main body in the lengthwise direction, and disk-shaped adjusting members are formed within the part of the main body connecting to the exit ports. The branch wires are wrapped around the radial perimeter of the adjusting member to an extent that achieves the desired branch wire length.

Because the construction of the present invention adjusts the length of the branch wire by wrapping the branch wire around the radial perimeter of the adjusting member, damage to the branch wires, which would otherwise result from loosely hanging branch wires contacting components external to the wiring protector, is prevented. The construction of the present invention also prevents loosely hanging branch wires generating noise as a result of vehicle vibrations.

Moreover, should the adjusting member be formed of an elastic material, pulling on the branch wire to connect the terminal end to a device connector has the effect of radially compressing the adjusting member. After the connection is made, the elastic material expands to its original condition, thereby removing the looseness from the branch wire.

Additionally, the wiring protector of the present invention controls the length and exiting direction of branch wires extending from the trunk wires of a wiring harness attached to a vehicle. A passageway is provided in the main body for the passage of the trunk wires, branch wire exit ports are formed within and aligned along the front wall of the main body in the lengthwise direction, and disk-shaped adjusting members are formed within the part of the main body connecting to the exit ports, each adjusting member having branch wire guide channels formed therein in a radial pattern extending outwardly from the center. The length of a branch wire and its exiting direction are controlled by wrapping the branch wire around the radial perimeter of the adjusting member or pulling the branch wire through the desired guide channel.

The construction of the present invention, through which the adjusting member determines the direction that a branch wire exits the wiring protector, is thus able to control the direction of a branch wire and to ease the connection of branch wire terminal ends to devices.

The branch wire may be placed within an enclosing tube, and the branch wire, together with the enclosing tube, inserted into and secured within the branch wire guide channel. This construction of the present invention not only determines the direction that the branch wire exits the adjusting member, but also pinches the tube-enclosed branch wire between the sidewalls of the branch wire guide channel in the adjusting member, thus preventing displacement of the tube without the need to secure the tube with a tape wrapping.

The adjusting member of the present invention may be formed separately from the wiring protector, the adjusting member being fixedly attached to a box structure having open upper and front sides, a branch wire passage port provided at the rear side of the box structure, and a pair of leg portions, on which lock fingers are formed at the extremities, extending from the bottom. Holes for the insertion of the leg portions are provided adjacent to the branch wire exit ports on the main body, and the lock fingers secure the leg portions within the holes.

This construction of the present invention allows the adjusting members to be attached to the wiring protector at any location where the direction and length of the branch wire are to be regulated.

Further, the wiring protector of the present invention controls the length and exiting direction of branch wires extending from the trunk wires of a wiring harness attached to a vehicle. A passageway is provided within the main body for the passage of the trunk wires. Branch wire exit ports are formed within and aligned along the front wall of the main body in the lengthwise direction, and a pair of gripping parts are located adjacent to an exit port. A branch wire exiting from the exit port is covered by a tube, the tube-covered branch wire being inserted and fixedly held between the gripping parts.

The construction of the present invention employs gripping parts to compress the tube enclosing the branch wire, therefore preventing displacement of the tube without the use of a tape wrapping.

As previously noted, the wiring protector of the present invention adjusts the length of a branch wire by wrapping the branch wire around the perimeter of the adjusting member, and therefore is able to prevent damage caused by loosely hanging branch wires contacting objects external to the wiring protector and from generating noise induced by vehicle vibration. Moreover, if the adjusting member is made of an elastic material, pulling on the branch wire, at the time when the terminal connector of the branch wire is to be connected to a device, has the effect of radially compressing the adjusting member. After the connection is made, the elastic material expands and returns to its original shape, thereby removing any residual looseness in the branch wire.

According to an aspect of the present invention, a wiring protector that determines length and exit direction of branch wires that extend from trunk wires of a wiring harness is provided, the wiring protector including a main body including a passageway provided for passage of the trunk wires; a branch wire exit port provided within and aligned along a front wall of the main body; and an adjusting member provided in the main body and connecting to the branch wire exit port; wherein the branch wires are wrapped around a perimeter of the adjusting member to an extent that establishes a desired branch wire length. Further, the wiring protector may include a plurality of branch wire exit ports provided within and aligned along a front wall of the main body; and a plurality of adjusting members provided in the main body, each the adjusting member connecting to one of the plurality of branch wire exit ports. Further, the adjusting member is disk shaped, so that the branch wires are wrapped around a circular perimeter of the adjusting member. The adjusting member may be constructed of an elastic material, and pulling the branch wires wrapped around the adjusting member reduces the diameter of the adjusting member to connect the ends of the branch wires to a device, and release of the branch wires wrapped around the adjusting member allows the adjusting member to return substantially to its original diameter. Further, a bracket extending from an external surface of the main body is provided; and the bracket may be configured to attach the wiring protector to a vehicle body.

A further aspect of the present invention provides a wiring protector that determines length and exit direction of branch wires that extend from trunk wires of a wiring harness, the wiring protector including a main body including a passageway provided for passage of the trunk wires; at least one branch wire exit port formed within and aligned along a front wall of the main body; and at least one disk shaped adjusting member provided within the main body, each the disk shaped adjusting member connecting to a respective branch wire exit port, each the adjusting member including branch wire guide channels arranged in a radial pattern extending outward from the center of the disk shaped adjusting member; wherein the length of a branch wire and its exit direction are determined by wrapping the branch wire around the perimeter of the adjusting member or positioning the branch wire within a branch wire guide channel. Further, the branch wires are covered by tubes, each the branch wire guide channel further including two sidewalls, the two sidewalls configured to pinch and secure the tube covered branch wires therebetween. The adjusting member may further include a box structure fixedly attached to the adjusting member, the box structure including open upper and front sides, a branch wire passage port formed within a rear side of the box structure, and a pair of leg parts including lock fingers formed at extremities thereof and extending from a bottom side of the box structure; and the main body further including apertures provided adjacent to the branch wire exit ports, the apertures configured for insertion of the leg parts therein to lock the leg parts into the apertures through the lock fingers. The adjusting member may further include a box structure fixedly attached to the adjusting member, the box structure including open upper and front sides, a branch wire passage port formed within a rear side of the box structure, and a pair of leg parts including lock fingers formed at extremities thereof and extending from a bottom side of the box structure; and the main body further including apertures provided adjacent to the branch wire exit ports, the apertures configured for insertion of the leg parts therein to lock the leg parts into the apertures through the lock fingers. In a further aspect of the present invention, wiring protector that determines length and exit direction of branch wires that extend from trunk wires of a wiring harness is provided, the wiring protector including a main body including a passageway provided for passage of the trunk wires; branch wire exit ports formed within and aligned along a front wall of the main body; and a pair of grip parts provided in the main body and adjacent to an exit port, the pair of grip parts configured to receive the branch wires therebetween. Further, the branch wires are covered by tubes, and the pair of grip parts configured to fixedly hold the tube covered branch wires therebetween.

BRIEF DESCRIPTION OF THE DRAWINGS

The above, and other objects, features and advantages of the present invention will be made apparent from the following description of the preferred embodiments, given as nonlimiting examples, with reference to the accompanying drawings in which:

FIG. 7A is a perspective view of the length adjustment element of the embodiment of FIG. 6;

FIG. 7B a plan view of the length adjustment element of the embodiment of FIG. 6, showing the branch wire installed without tension;

FIG. 7C is a plan view of the length adjustment element of the embodiment of FIG. 6, showing the branch wire provided in a tensioned condition.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The following will describe the preferred embodiments with reference to the drawings. FIGS. 1, 2, 3, and 4 illustrate the first embodiment.

Figure 1:
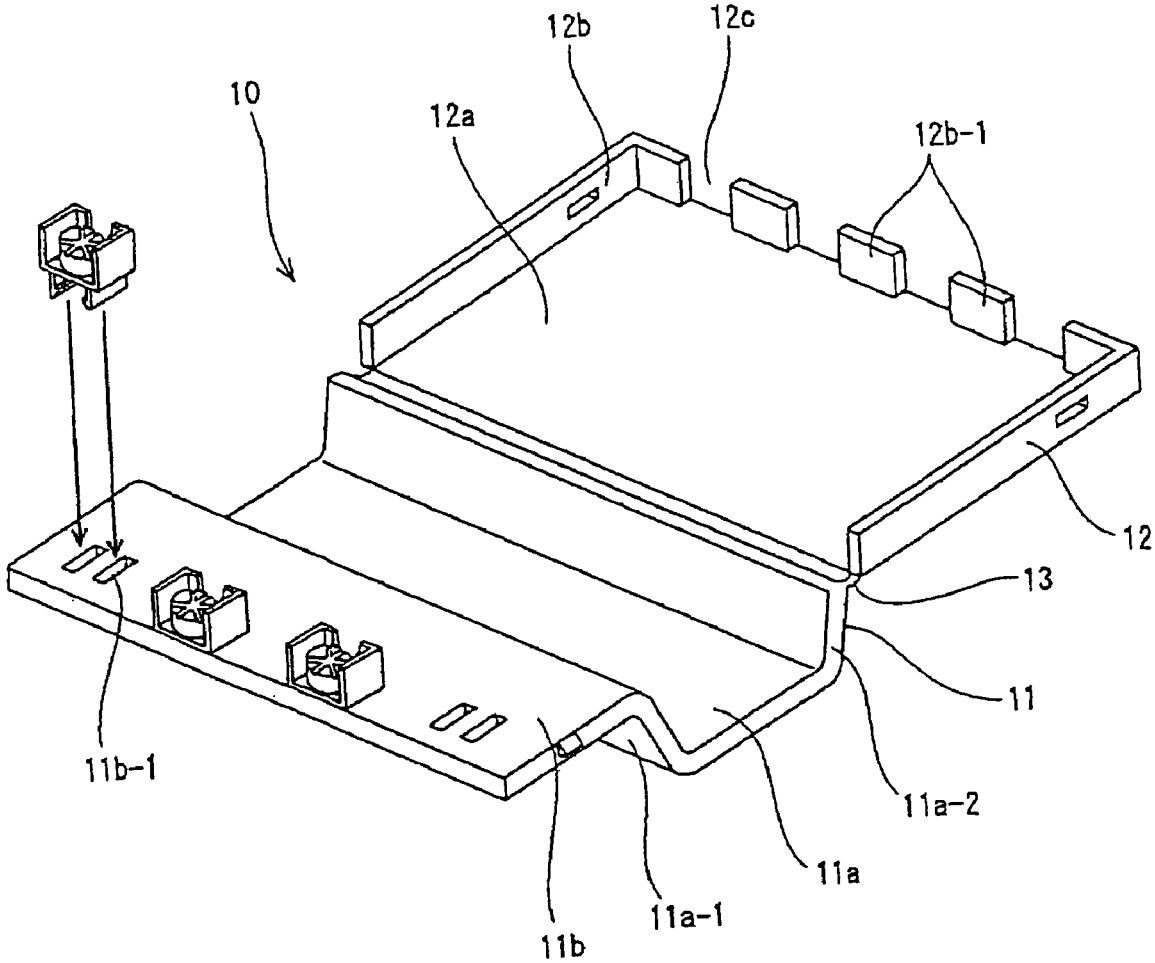
FIG. 1 is a perspective view of the wiring protector of a first embodiment of the present invention.

FIG. 1 illustrates wiring protector 10 as a component that may be installed in the engine compartment of an automobile at a location where wires branch off from wire harness WH. Wiring protector 10 may be constructed of any suitable material such as, for example, resin. Wiring protector 10 may be formed unitarily and in one piece including main body 11 which contains branch points T1, T2, T3 at which branch wires w2, w3, w4, w5, w6, w7 extend away from trunk wires w1 of wire harness WH, cover portion 12 that seals the upper side of main body 11 (which houses trunk wires w1 of wire harness WH), and hinge part 13. The hinge part 13 may be a thinly formed flexible portion of the wiring protector 10. The wire harness WH used in the present invention includes a plurality of branch points and a plurality of branch wires, and in the present embodiment, includes branch points T1, T2, T3 and includes branch wires w2, w3, w4, w5, w6, w7.

Main body 11 includes trunk wire passage 11*a*, and substantially planar branch wire exit portion 11*b* that extends horizontally outward from the upper edge of sidewall 11*a*-1 of trunk wire passage 11*a*. Multiple apertures 11*b*-1 are provided near the edge of branch wire exit portion 11*b* for the installation of directional regulators 20 (to be subsequently described). The present invention includes a suitable number of apertures 11*b*-1 for mounting a suitable number of directional regulators 20, and in this embodiment provides two apertures 11*b*-1 for the installation of each directional regulator 20, and a total of eight apertures 11*b*-1 for the installation of four directional regulators 20. Cover 12 extends from the upper edge of sidewall 11*a*-2 of main body 11 through flexible hinge part 13, sidewall 11*a*-2 located on the side of main body 11 opposite to sidewall 11*a*-1. Moreover, bracket 11*c* extends externally from main body 11 as a member through which wiring protector 10 is secured to the vehicle body. Bracket 11*c* may include any suitable member for attachment to the vehicle body such as, for example, a bolt hole that receives a bolt.

Cover 12 includes upper wall 12*a* that forms the top part of main body 11, flexible hinge part 13 of upper wall 12*a*, and side wall 12*b* that extends from the periphery of cover 12 except for the edge portion of cover 12 that connects to flexible hinge part 13. With cover 12 placed in a closed position over main body 11 by pivoting flexible hinge part 13, front wall 12*b*-1, which is formed as part of sidewall 12 at the edge of branch wire exit portion 11*b*, aligns with the edge of branch wire exit portion 11*b*. Branch wire exit ports 12*c* are formed in sidewall 12, at locations corresponding to the installation positions of directional regulators 20 on main body 11, in order to allow the branch wires to exit. Branch wire exit ports 12*c* are formed in any suitable manner such as, for example, by being formed as cut out portions of the sidewall 12.

Figure 2A:
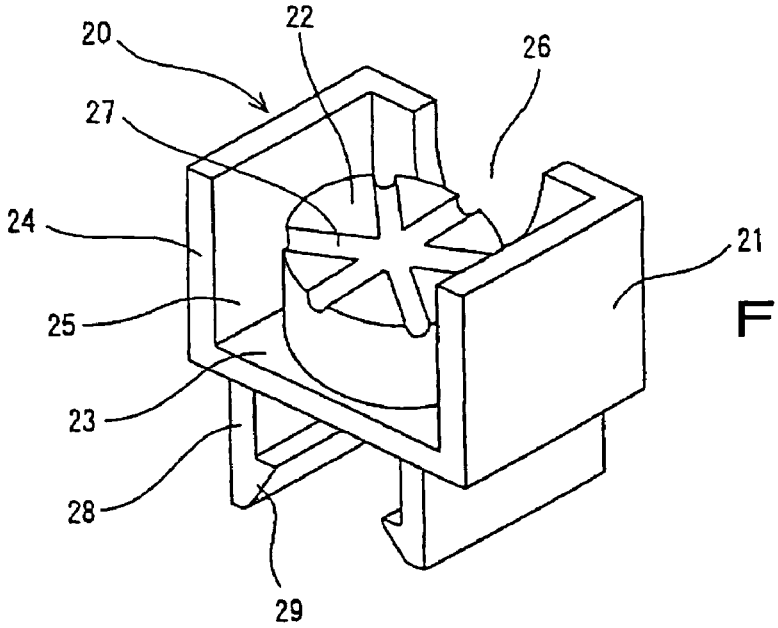
FIG. 2A is a perspective view of a directional regulator in the wiring protector of the embodiment of FIG. 1.

As illustrated in FIG. 2A, directional regulator 20, which is mounted to branch wire exit portion 11*b* of main body 11, includes disc-shaped guide member 22 formed within box 21. The disc shaped guide member 22 may be formed integrally and in one piece with the box 21. Box 21 includes rectangular floor portion 23 that connects to the lower surface of guide member 22, and frame member 24 that extends upward from the edge of floor portion 23. One of the four sides of frame member 24 is open to form branch wire exit port 25, and passage port 26 is formed in frame member 24, opposite to exit port 25, in order to allow branch wires to pass into directional regulator 20. Passage ports 26 are formed in any suitable manner such as, for example, by being formed as cut out portions of the frame member 24.

Figure 2B:
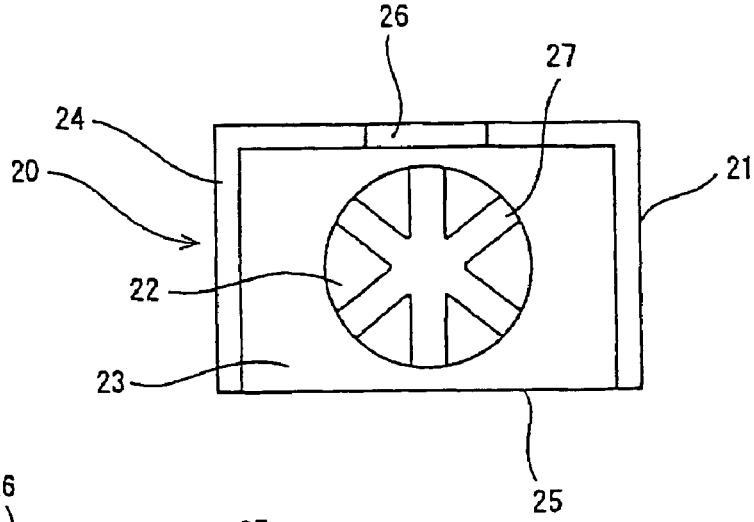
FIG. 2B is a plan view of the directional regulator in the wiring protector of the embodiment of FIG. 1.
Figure 2C:
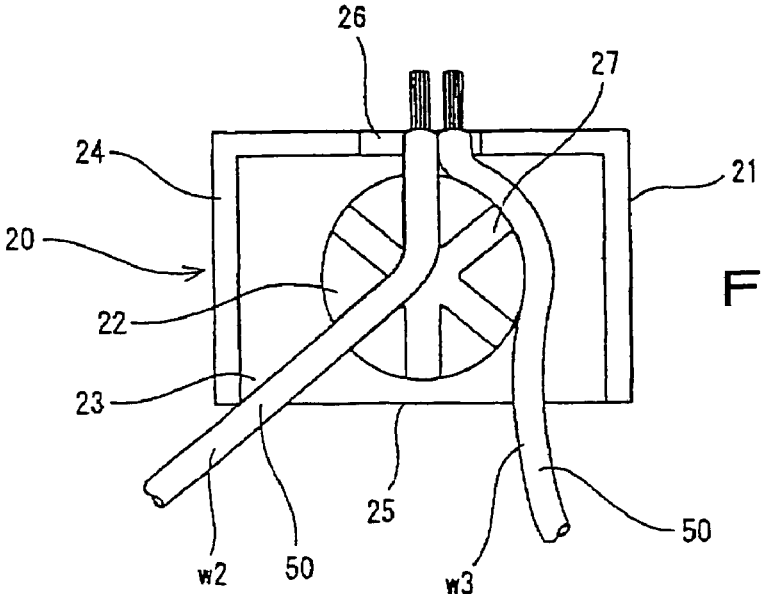
FIG. 2C is a plan view of the directional regulator in the wiring protector of the embodiment of FIG. 1, showing branch wires.

As shown in FIG. 2B, guide channels 27 are formed within the upper surface of disc-shaped guide member 22 and radiate outward from the center of the guide member. In the present embodiment, each guide channel 27 is radially spaced 60 degrees from adjacent channels, and all guide channels mutually intersect at the center of guide member 22. Alternatively, the disc-shaped guide member 22 may include a fewer number of guide channels 27, or a greater number of guide channels 27. Further, the guide channels 27 may be radially spaced from adjacent guide channels 27 a distance other than 60 degrees. Directional regulator 20 is able to regulate the direction of the branch wires, as shown in FIG. 2C, for example, by guiding branch wires w2 through guide channel 27 on the upper side of guide member 22, and guiding branch wires w2 along the radial peripheral surface of guide member 22. Furthermore, leg portions 28, which extend downward from the lower surface of floor portion 23 of box 21, include lock fingers 29 formed on their extremities.

Figure 3:
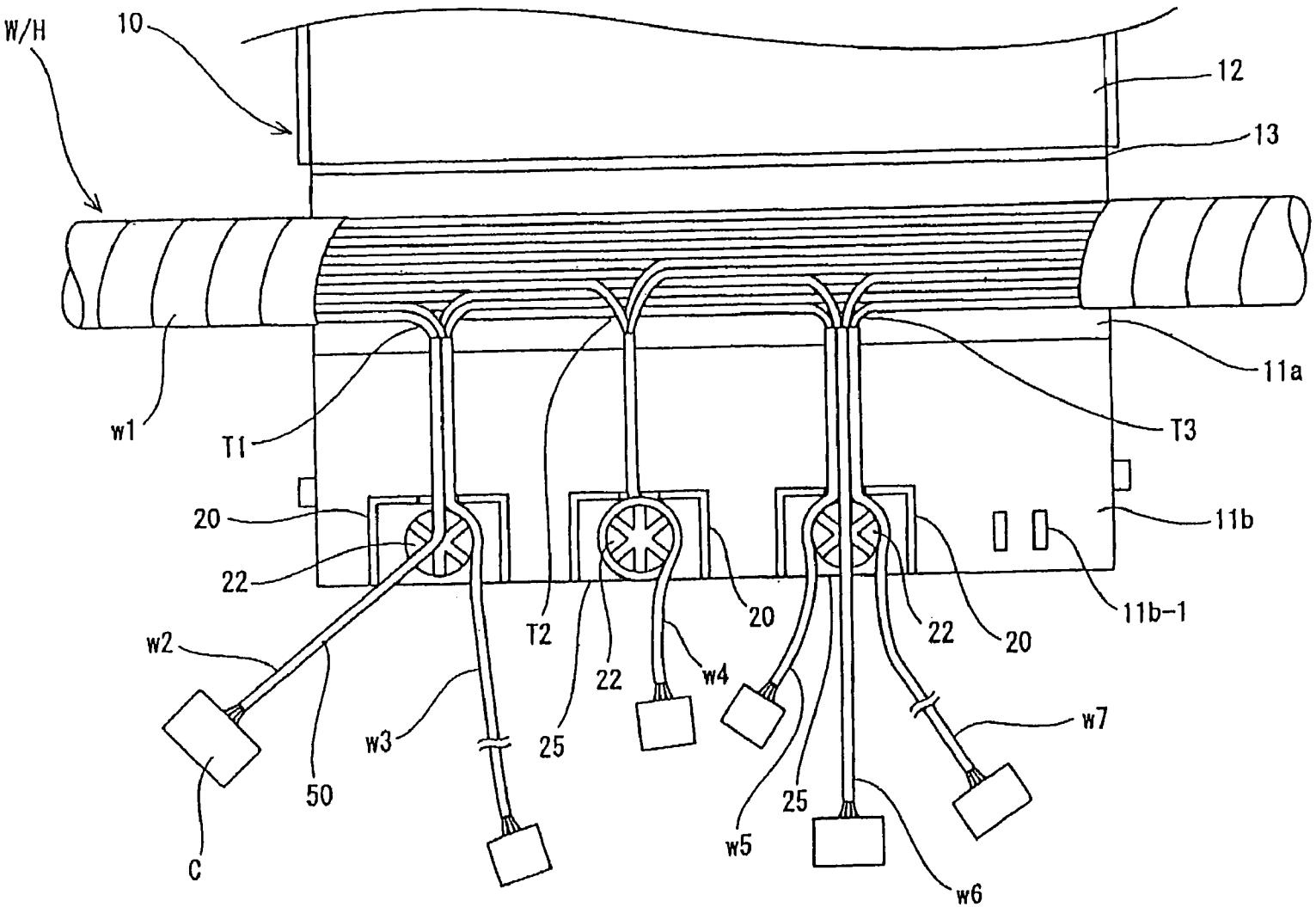
FIG. 3 is a plan view of the wiring protector of the embodiment of FIG. 1, showing the arrangement of the wire harness within the wiring protector.

As shown in FIG. 3, wire harness WH, which is enclosed by wiring protector 10, may include any suitable number of branch locations and in the present embodiment includes the three branch locations of T1, T2, and T3. Branch wires w2 and w3 separate from the harness at branch location T1, branch wires w4 separate at branch location T2, and branch wires w5, w6, and w7 separate at branch location T3. PVC tube 50 is placed over branch wires w2–w7, and connector C is attached to the terminal ends. In the present embodiment, three directional regulators 20 are fixedly attached to branch wire exit portion 11*b* of main body 11 at locations corresponding to the three branch points T1–T3. The remaining attachment aperture 11*b*-1 is, in this embodiment, an optional attachment position to which a directional regulator 20 has not been installed. Additionally, main body 11 may include any suitable number of branch wire exit ports 12*c*.

With trunk wires w1 of wire harness WH placed within trunk wire passage 11*a* of main body 1, the direction of each group of branch wires w2–w7 (which branch off from trunk wires w1) is controlled by the branch wires being attached to a respective directional regulator 20. As previously noted, branch wires w2 are inserted into guide channel 27 while branch wires w3 pass around the radial perimeter of guide member 22. Branch wires w4 wrap completely around the radial perimeter of guide member 22 and exit from branch wire exit port 25. Branch wires w6 run straight through guide channel 22 while branch wires w5 and w7 pass around opposing sides of the radial perimeter of guide member 22. Branch wires w5–w7 exit from branch wire exit port 25.

Figure 4:
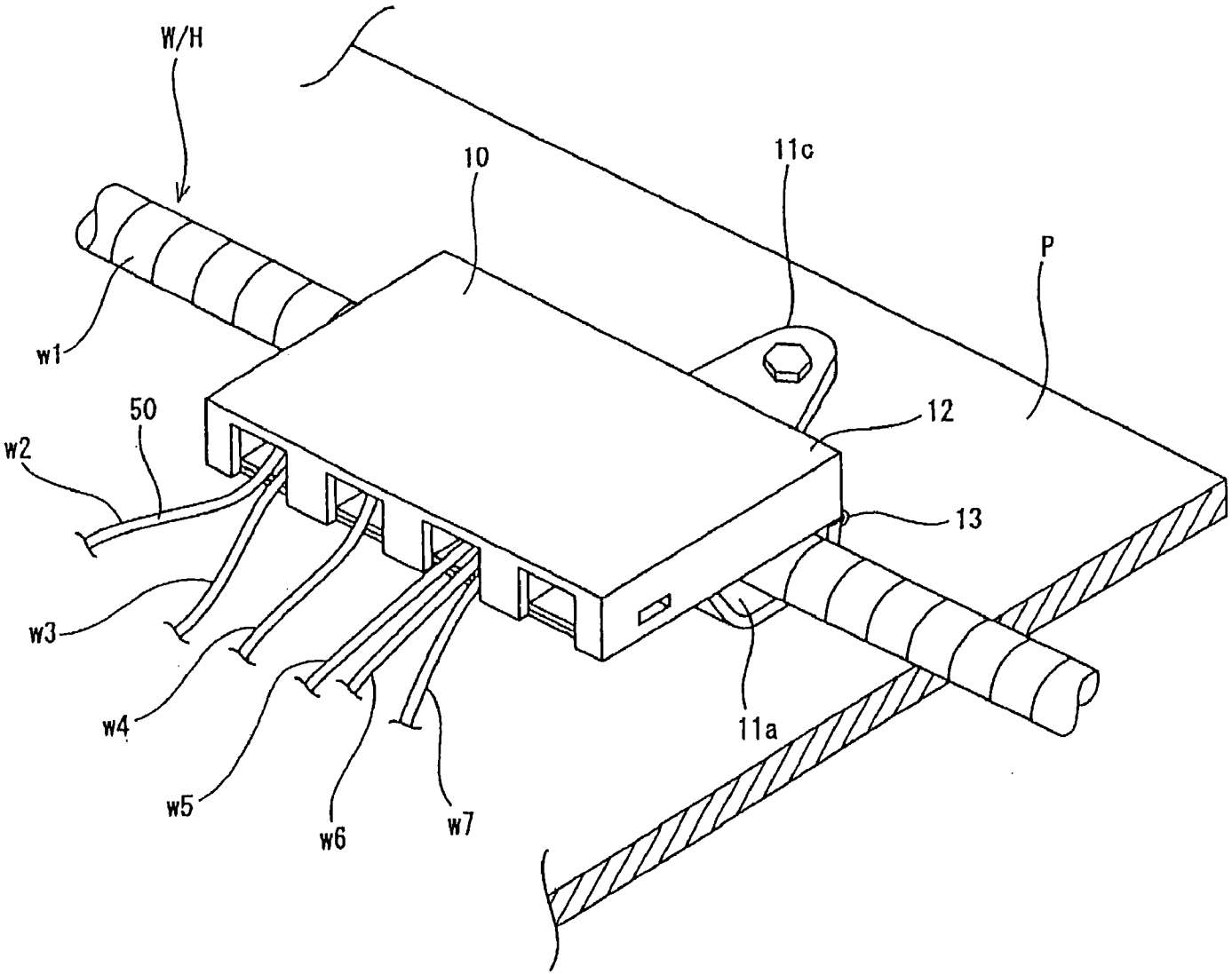
FIG. 4 is a perspective view of the wiring protector of the embodiment of FIG. 1 provided in a vehicle body panel.

After wire harness WH has been arranged within main body 11, cover 12 pivots on thinly formed hinge part 13 and encloses the upper part of and locks against main body 11. In this configuration, as shown in FIG. 4, wiring protector 10 is attached to panel 'P' of the engine compartment through bracket 11*c* with the connectors of branch wires w2–w7, which extend from wiring protector 10, connected to the connectors of corresponding electrical devices which are not shown in the drawing.

The construction of the present invention uses directional regulators 20 to control the direction that branch wires w2–w7 exit from wiring protector 10, and in doing so is able to freely establish the directions in which branch wires w2–w7 extend, thus allowing the terminal connectors of branch wires w2–w7 to be easily connected to their corresponding devices. Moreover, because PVC tube 50, which covers branch wires w2 and w6, is pinched between the two walls of guide channel 27 of guide member 22, PVC tube 50 is securely attached to branch wires w2 and w6 without the need for tape wrapping. Although this embodiment describes directional regulators 20 as separately formed components to be attached to wiring protector 10, directional regulators 20 may also be formed unitarily and in one piece with the wiring protector 10.

Figure 5A:
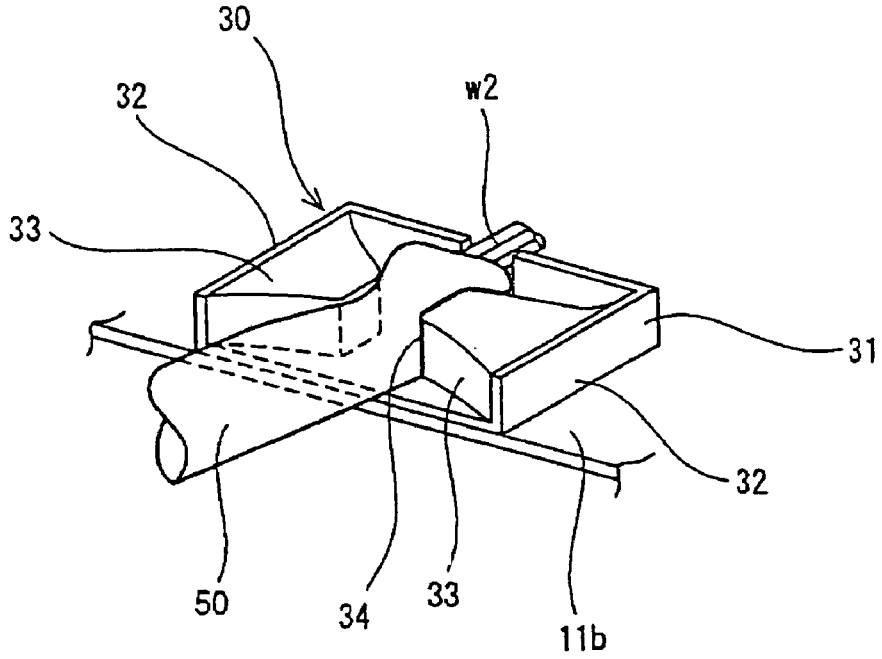
FIG. 5A is a perspective view of a wire clamp of a second embodiment of the present invention.
Figure 5B:
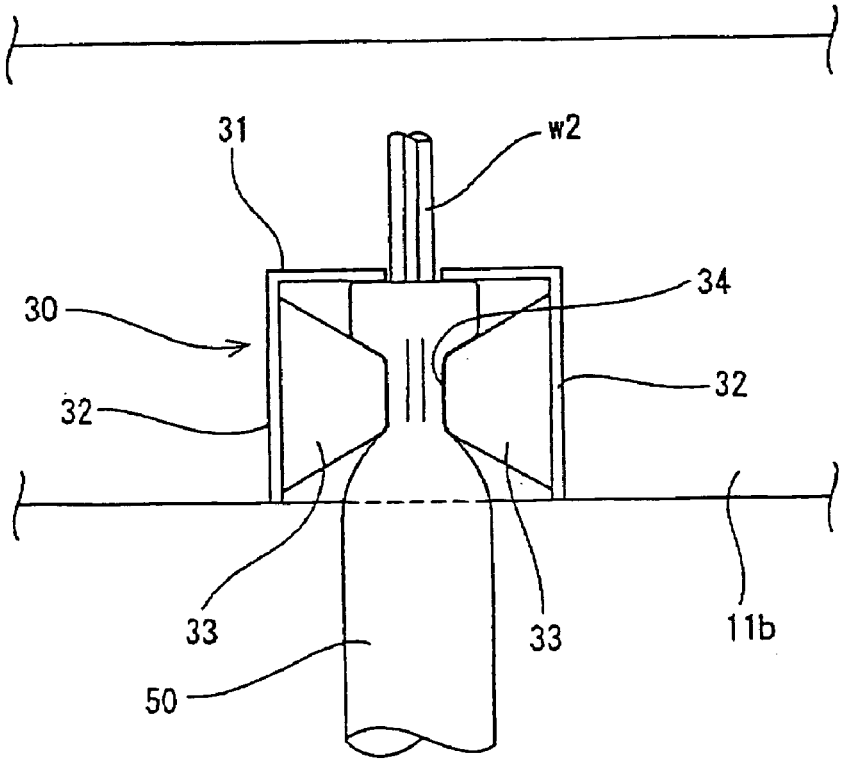
FIG. 5B is a plan view of the wire clamp of the embodiment FIG. 5A.

FIG. 5A illustrates a second embodiment of the invention wherein the wire attachment part is provided in the form of wire clamp 30 (shown in FIG. 5A), which differs from the wire attachment part described by the first embodiment, attached to branch wire exit portion 11*b* of main body 11. Branch wire clamp 30 includes gripping portions 33 that extend inward from the two sidewalls 32 of box 31, which is of the same general configuration as box 21 of the first embodiment. The width of each grip portion 33 continually narrows as the block extends inward along the horizontal plane. Wire passage 34 provides passage for branch wire w2 between the tip parts of gripping portion 33, the width of wire passage 34 being established to a dimension slightly larger than the width of branch wires w2.

Branch wires w2, which are enclosed within PVC tube 50, are pulled into wire clamp 30, and the part of branch wire w2 covered by PVC tube 50 is inserted into wire passage 34 between gripping portions 33. The compression of PVC tube 50 between gripping portions 33 securely holds branch wires w2 in place.

The construction of the present invention eliminates the need to secure PVC tube 50 to branch wires w2 through tape wrapping because PVC tube 50 (which encloses branch wires w2) is compressed between gripping parts 33 of wire clamp 30. Elements shared by the first and second embodiments are identified by the same element numbers.

Figure 6:
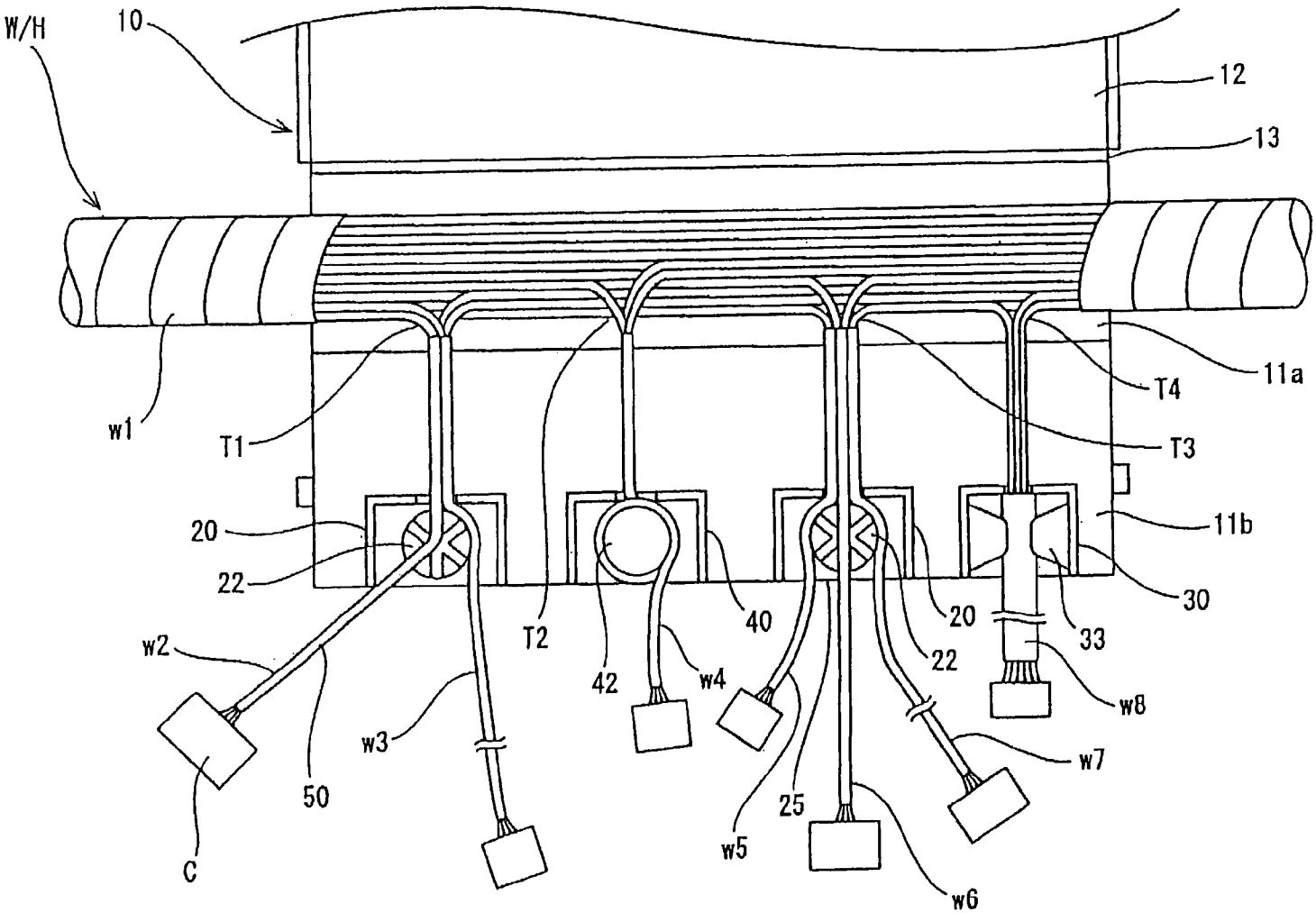
FIG. 6 is a plan view of the wiring protector of a third embodiment of the present invention, showing the arrangement of the wire harness within the wiring protector.
Figure 8:
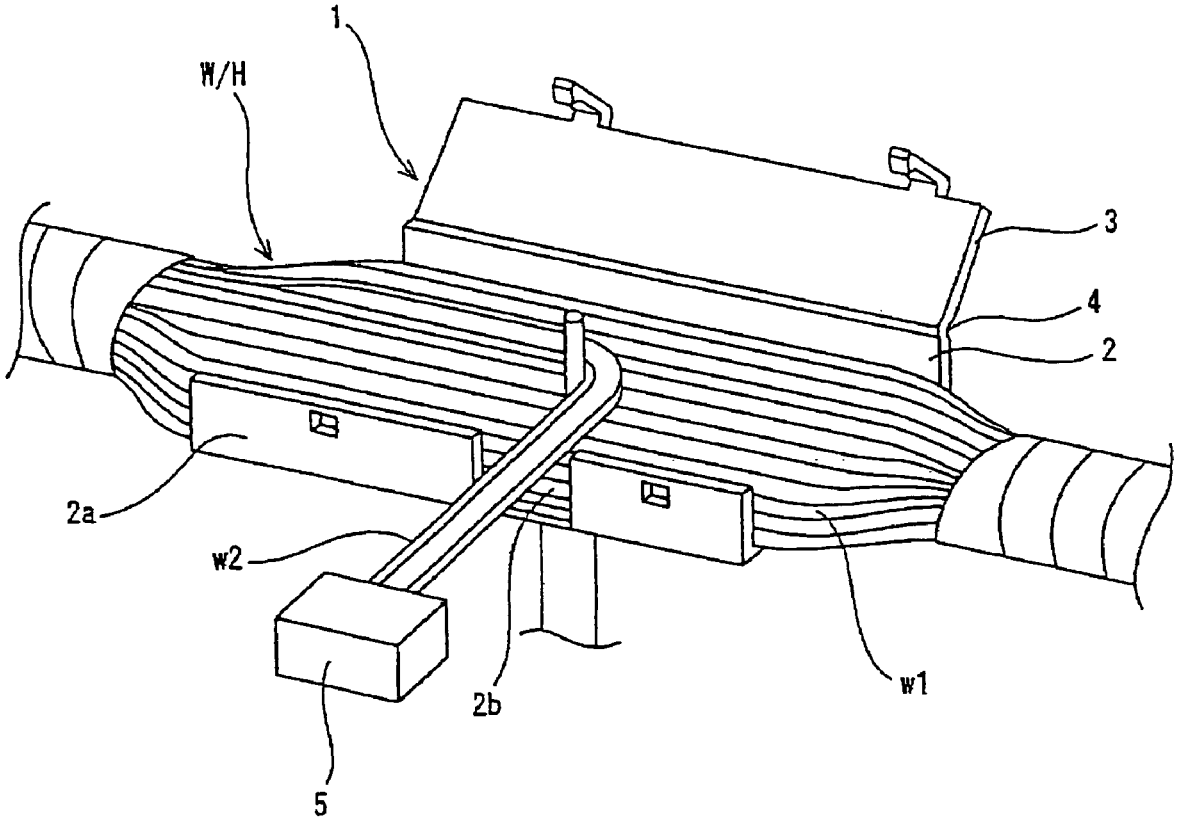
FIGURE 8 PRIOR ART
FIG. 8 is a perspective view of a known wiring protector.

FIGS. 6 and 7 illustrate a third embodiment of the invention wherein the extending directions of branch wires w2, w3, w5, w6, and w7, which lead away from trunk wires w1 of wire harness WH, are controlled by directional regulators 20 as described in the first embodiment. Branch wires w8, which extend from branch point T4, are held within wire clamp 30 as described in the second embodiment. The length of branch wires w4 is adjusted by length adjuster 40.

Length adjuster 40, as shown in FIG. 7A, includes disk-shaped adjuster element 42 which is formed within box 41 in a similar configuration to directional regulator 20. Length adjuster 42, which is made from an elastic material, connects to box 41 through a post (not shown) that projects from the center of the lower surface of length adjuster 42. As shown in FIG. 7B, branch wires w4 are typically wrapped around adjuster element 42 to an extent that establishes the desired length. When the terminal connector on the end of branch wires w4 is to be connected to a specific device, branch wires 4, as shown in FIG. 7C, are pulled out toward the device, thus reducing the diameter of adjuster element 42 as a result of the compression applied by the tightened coil of wire. After branch wires w4 have been connected to the device, length adjuster element 40 returns to its original diameter from the reduced tension applied to branch wires w4, thus eliminating any slack in branch wires w4.

The construction of the present invention is able to adjust the length of branch wires w4 by coiling the wires around adjuster element 42. Therefore, damage to wires w4, which would otherwise result from their interference with adjacent structures, is prevented. Moreover, noise, which would otherwise result from loosely hanging wires w4 coming into contact with a vibrating vehicle body, is also prevented. Moreover, because adjuster element 42 is made from an elastic material, applying axial tension to branch wires w4, at the time when the wire terminal connector is to be attached to its respective device, reduces the diameter of adjuster element 42. After the connector has been connected, the reduction of axial tension on the wires allows adjuster element 42 to return to its original diameter, thus eliminating any remaining looseness in branch wires w4. Furthermore, in this third embodiment, the attachment of directional regulator 20, wire clamp 30, and length adjuster element 40 allow the wiring protector to provide the branch wire adjustment functions that these components make possible. Alternatively, adjuster element 42 may be constructed of a material such as, for example, the same hard resin as box 41, and not from an elastic material. Descriptions of the structures and operational effects of this third embodiment identified by element numbers identical to those of the first embodiment have been omitted.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Application No. JP 2003-385867, filed on Nov. 14, 2003, which is herein expressly incorporated by reference in its entirety.

What is claimed is:

1. A wiring protector that determines length and exit direction of branch wires that extend from trunk wires of a wiring harness, said wiring protector comprising:

a main body including a passageway provided for passage of the trunk wires;

a branch wire exit port provided within and aligned along a front wall of said main body; and an adjusting member provided in said main body and connecting to said branch wire exit port;

wherein the branch wires are wrapped around a perimeter of said adjusting member to an extent that establishes a desired branch wire length;

said adjusting member further comprising:

a box structure fixedly attached to said adjusting member, said box structure including open upper and front sides, a branch wire passage port formed within a rear side of said box structure, and a pair of leg parts including lock fingers formed at extremities thereof and extending from a bottom side of said box structure; and said main body further comprising apertures provided adjacent to said branch wire exit ports, said apertures configured for insertion of said leg parts therein to lock said leg parts into said apertures through said lock fingers.

2. The wiring protector according to claim 1, further comprising:

a plurality of branch wire exit ports provided within and aligned along a front wall of said main body; and a plurality of adjusting members provided in said main body, each said adjusting member connecting to one of said plurality of branch wire exit ports.

3. The wiring protector according to claim 1, wherein said adjusting member is disk shaped, so that the branch wires are wrapped around a circular perimeter of said adjusting member.

4. The wiring protector according to claim 1, further comprising:

a bracket extending from an external surface of said main body.

5. The wiring protector according to claim 4, said bracket configured to attach said wiring protector to a vehicle body.

6. A wiring protector that determines length and exit direction of branch wires that extend from trunk wires of a wiring harness, said wiring protector comprising:

a main body including a passageway provided for passage of the trunk wires;

at least one branch wire exit port formed within and aligned along a front wall of said main body; and at least one disk shaped adjusting member provided within said main body, each said disk shaped adjusting member connecting to a respective branch wire exit port, each said adjusting member including branch wire guide channels arranged in a radial pattern extending outward from the center of said disk shaped adjusting member;

wherein the length of a branch wire and its exit direction are determined by wrapping the branch wire around the perimeter of said adjusting member or positioning the branch wire within a branch wire guide channel.

7. The wiring protector according to claim 6, wherein the branch wires are covered by tubes, each said branch wire guide channel further comprising:

two sidewalls, said two sidewalls configured to pinch and secure the tube covered branch wires therebetween.

8. The wiring protector according to claim 6, said adjusting member further comprising:

a box structure fixedly attached to said adjusting member, said box structure including open upper and front sides, a branch wire passage port formed within a rear side of said box structure, and a pair of leg parts including lock fingers formed at extremities thereof and extending from a bottom side of said box structure; and said main body further comprising apertures provided adjacent to said branch wire exit ports, said apertures configured for insertion of said leg parts therein to lock said leg parts into said apertures through said lock fingers.

* * * * *